United States Patent [19]

Huber, Jr. et al.

[11] Patent Number: 4,750,403

[45] Date of Patent: Jun. 14, 1988

[54] SPIN DISPENSING METHOD AND APPARATUS

[75] Inventors: Joseph C. Huber, Jr., Cuyahoga Falls; Bellur L. Nagabhushan, North Canton, both of Ohio

[73] Assignee: Loral Corporation, New York, N.Y.

[21] Appl. No.: 6,849

[22] Filed: Jan. 27, 1987

Related U.S. Application Data

[62] Division of Ser. No. 824,826, Jan. 31, 1986, Pat. No. 4,676,167.

[51] Int. Cl.[4] ..... F42B 13/50; F42B 25/16

[52] U.S. Cl. ..... 89/1.51; 89/1.11

[58] Field of Search ..... 89/1.51, 1.11, 1.56; 102/393, 489, 293, 351, 357

[56] References Cited

U.S. PATENT DOCUMENTS

| | | | |
|---|---|---|---|
| 2,362,414 | 11/1944 | Simpson | 102/393 |
| 2,972,294 | 2/1961 | Poulter | 102/393 |
| 3,016,011 | 1/1962 | Brown | 102/393 |
| 3,093,072 | 6/1963 | Pigman | 102/393 |
| 3,608,426 | 9/1971 | Jackson | 89/1.51 X |
| 3,983,783 | 10/1976 | Maxey | 102/393 X |
| 4,143,836 | 3/1979 | Rieger | 102/393 X |
| 4,172,407 | 10/1979 | Wentink | 89/1.11 X |
| 4,267,562 | 5/1981 | Raimondi | 89/1.11 X |
| 4,372,216 | 2/1983 | Pinson et al. | 102/393 X |
| 4,381,692 | 5/1983 | Weintraub | 102/364 X |
| 4,388,869 | 6/1983 | Edleson | 89/1.11 X |
| 4,406,227 | 9/1983 | Beeker et al. | 102/393 X |
| 4,444,117 | 4/1984 | Mitchell | 102/489 |
| 4,455,943 | 6/1984 | Pinson | 102/489 |
| 4,488,489 | 12/1984 | Schöffl | 102/489 |
| 4,494,437 | 1/1985 | von Maydell | 89/1.11 X |
| 4,498,393 | 2/1985 | Fischer et al. | 102/489 X |
| 4,555,971 | 12/1985 | Romer et al. | 89/1.11 |
| 4,583,461 | 4/1986 | Weber | 102/489 |

OTHER PUBLICATIONS

Navy Tech. Catalog 0501, Case No. 68837, A. H. Ryan, vol. II, No. 1, 09/1985.

Navy Tech. Catalog 0501, Case No. 68839, A. H. Ryan, vol. II, No. 1, 09/1985.

*Primary Examiner*—David H. Brown

*Attorney, Agent, or Firm*—P. E. Milliken; L. A. Germain

[57] ABSTRACT

An airborne spin dispensing apparatus (100,101) and method of dispensing a plurality of sub-units (60) such that the ground plane impact pattern of the plurality of sub-units substantially corresponds to a particular geometric ground target. An onboard microprocessor (24) which receives flight data (26) and a selected target data (28) also has a program store of sub-unit ejection sequences each of which corresponds to a particular target impact geometry. The microprocessor (24) selects an appropriate sub-unit ejection sequence in accordance with the flight and selected target data and effects a release of the sub-units (60) from the spinning apparatus such that their ground impact pattern substantially matches the geometry of the ground target.

5 Claims, 5 Drawing Sheets

FIG.-4
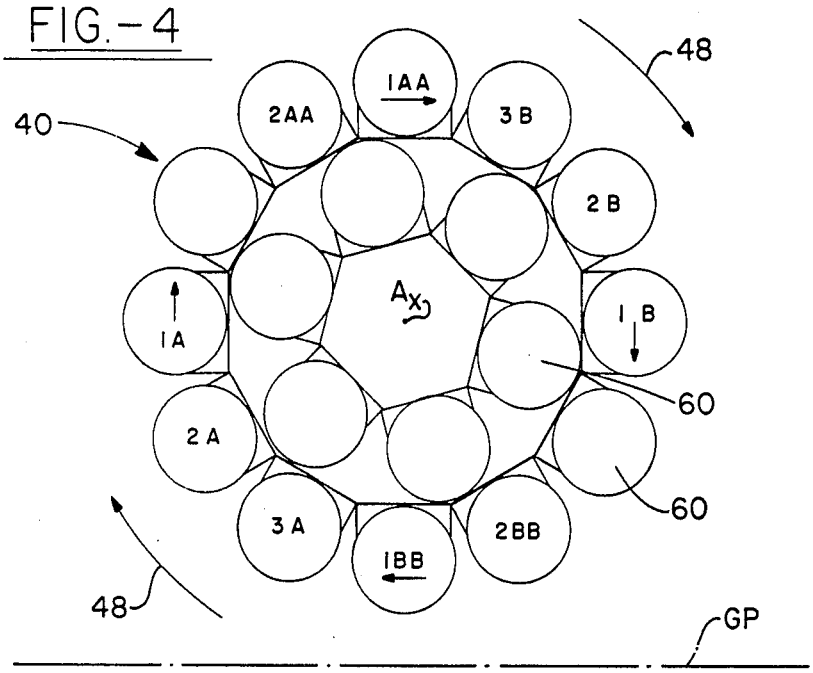
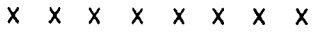
FIG.-5a
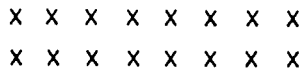
FIG.-5b
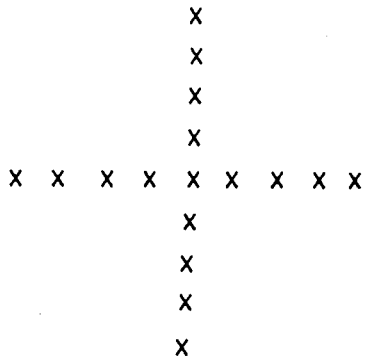
FIG.-5c
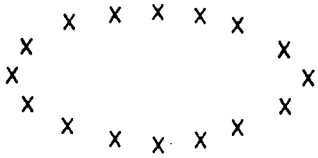
FIG.-5d
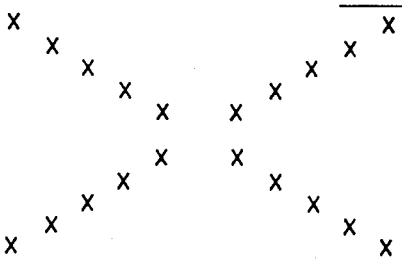
FIG.-5e

SPIN DISPENSING METHOD AND APPARATUS

This is a division of co-pending application Ser. No. 824,826 filed on Jan. 31, 1986 and now issued to U.S. Pat. No. 4,676,167 on June 30, 1987.

BACKGROUND OF THE INVENTION

This invention generally relates to the field of dispensing and more particularly to a method and apparatus for spin dispensing sub-units of a group in a manner to achieve a desired and predetermined dispersion impact pattern of the group over a particular ground target area.

This invention may be applied to both commercial and military applications. In a commercial application for example, the sub-units of the spin dispensing apparatus may comprise receptacles for carrying particulate material of the type including chemical fertilizers, insecticides, fungicides and the like which are dispersed over crop areas. The sub-unit receptacles are dispersed by the spin dispensing apparatus such as to impact a crop area in a particular predetermined geometric pattern and thus to achieve maximum coverage and efficient use of the materials over the crop area. Alternatively in a military application, the sub-units of the spin dispensing apparatus may comprise small mines, bomblets, grenades, or other type explosive ordnance or submunition. These type submunitions are dispersed in a controlled and predetermined manner over a target area to achieve an effective impact pattern for a particular geometric target area and thus optimizes target destruction.

The spin dispensing apparatus of this invention may be carried to a target area, whether a commercial or military application, by various type transport vehicles. For example, the apparatus may be carried in a self-propelled and guided drone or rocket-type vehicle or it may be launched from an aircraft in the vicinity of the target. The apparatus may also be carried in a projectile which is fired from a distant ground-based launching device. Alternatively, the apparatus may be affixed to a relatively stationary platform such as for example an aircraft. The particular configuration of the transporting vehicle will be dictated by the type of application and this will be apparent to persons having knowledge and skill in the art; suffice to say that the spin dispensing apparatus of this invention may be carried to a particular target area such as to present its most advantageous orientation to the target and thus accomplish the desired task.

SUMMARY OF THE INVENTION

It is in accordance with one aspect of the invention an object to provide a method of dispensing a plurality of sub-units from an airborne apparatus in a manner to achieve a desired and predetermined dispersion impact pattern of the sub-units over a particular geometric ground target area, the method comprising the steps of: mounting a plurality of sub-units in a balanced arrangement about a longitudinal axis of the apparatus, each sub-unit having an associated electronically controlled release means to effect ejection of the sub-unit from the apparatus; providing an on-board microprocessor having a store of particular sub-unit ejection sequences indicative of various specific impact geometries; spinning the apparatus about its longitudinal axis; providing flight data and a selected target data to the microprocessor such that a particular sub-unit ejection sequence is selected which substantially corresponds to the particular ground target geometry; and releasing the sub-units according to the microprocessor selected sub-unit ejection sequence.

It is in accordance with another aspect of the invention an object to provide an airborne apparatus for dispensing a plurality of sub-units in a manner to achieve a dispersion impact pattern over the target which closely approximates a particular geometric ground target area, the apparatus comprising in combination: a vehicle body framework having a longitudinal axis and defining a forward end, a rearward end, and a payload section between the forward and rearward ends; a plurality of sub-units individually mounted in the payload section in a balanced pattern about the longitudinal axis; means associated with each sub-unit to hold the sub-unit within the payload section during flight of the apparatus and adapted for releasing the sub-unit in response to an electrical ejection signal; means at the rearward end to impart spinning motion to the dispensing apparatus about its longitudinal axis; a control module including a power supply and a microprocessor, the microprocessor having a store of particular sub-unit ejection sequences which are indicative of various specific target geometries and the power supply providing the required power to the microprocessor and to the means for effecting release of the sub-units from the dispensing apparatus; sensor means providing flight data and spin rate data to the microprocessor as the apparatus approaches the target; and means providing a signal indicative of the particular geometric target to the microprocessor; said microprocessor providing a sub-unit ejection sequence signal to the plurality of means adapted for releasing each sub-unit such that the plurality of sub-units are ejected from the spinning dispenser apparatus in accordance with the ejection sequence signal.

DETAILED DESCRIPTION OF THE DRAWINGS

The invention and various aspects and advantages thereof will be better understood when consideration is given to the following detailed description and the accompanying drawings wherein in the several figures, like reference numerals indicate like elements and wherein:

FIG. 4 is an end view diagramatically illustrating a particular geometric arrangement of a plurality of sub-units which may be mounted to the spin-dispensing apparatus shown in FIG. 3;

Figure 6:
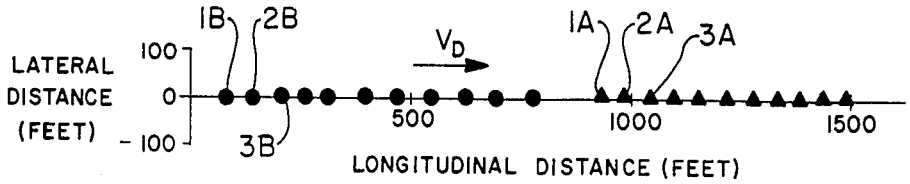
Figure 7:
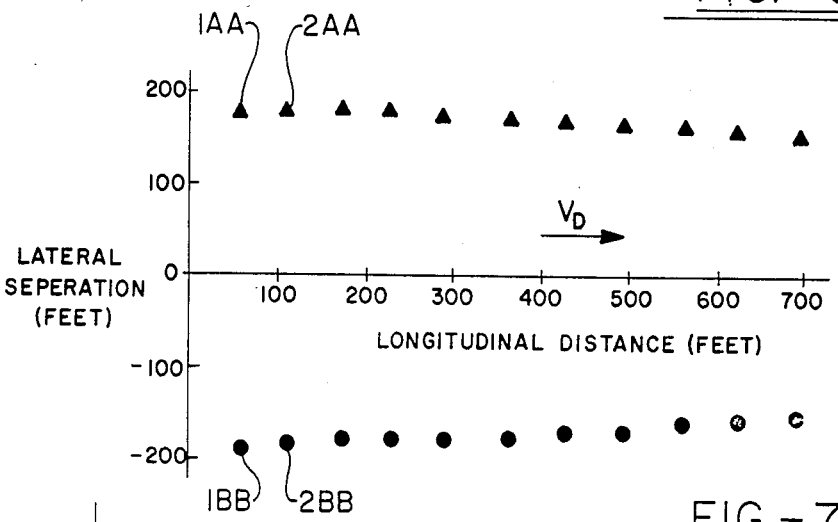
Figure 8:
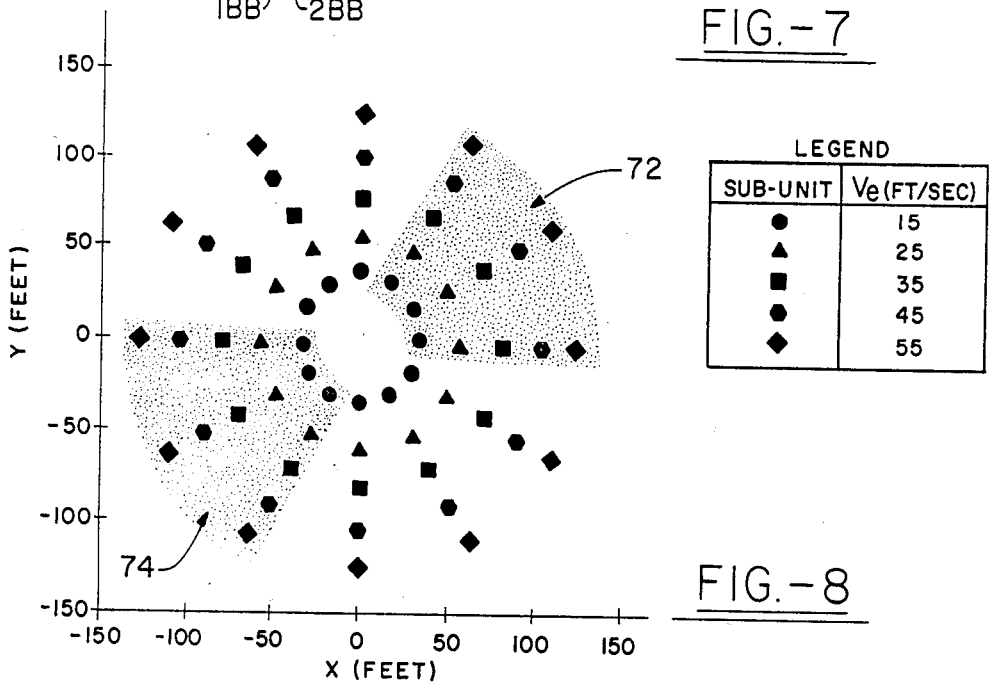
Figure 9:
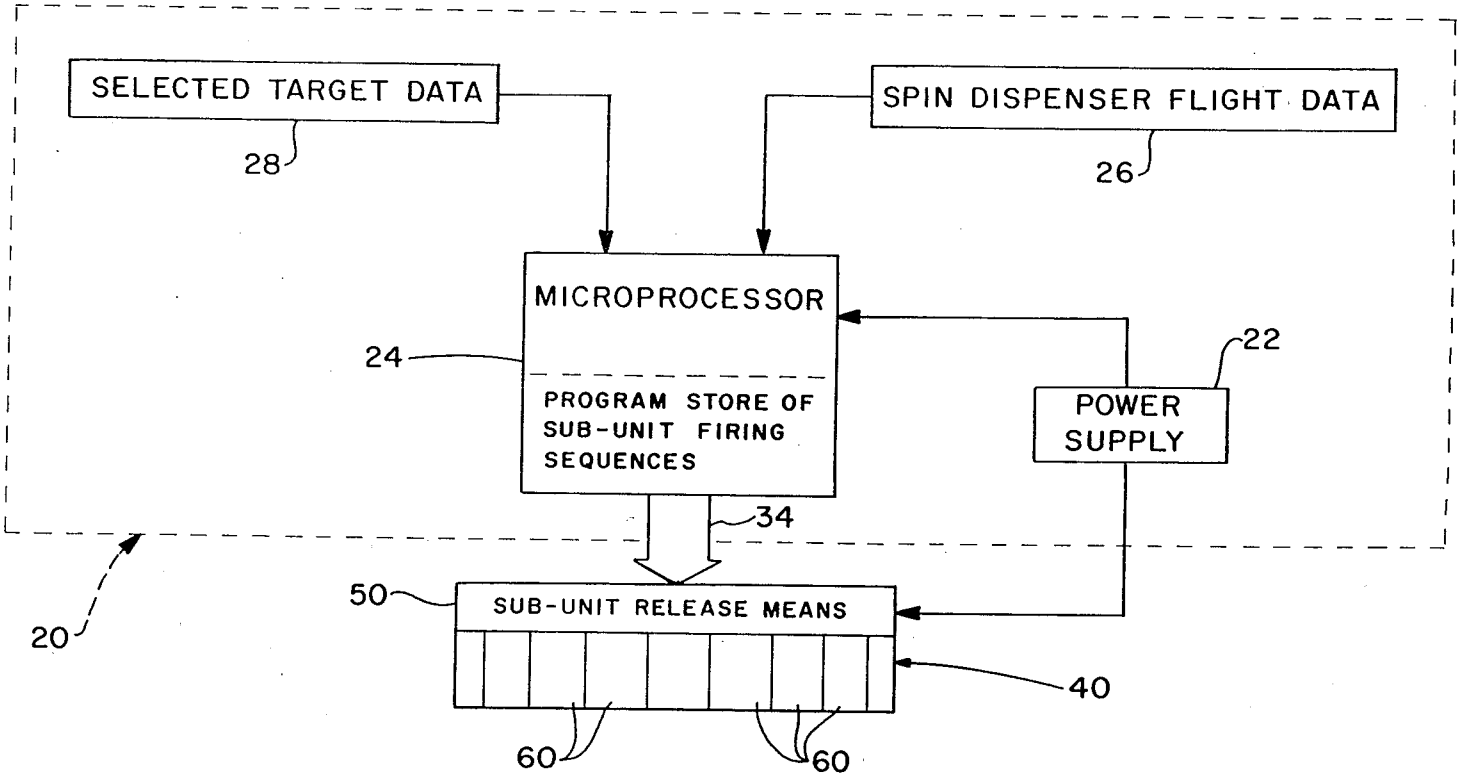
Figure 10:
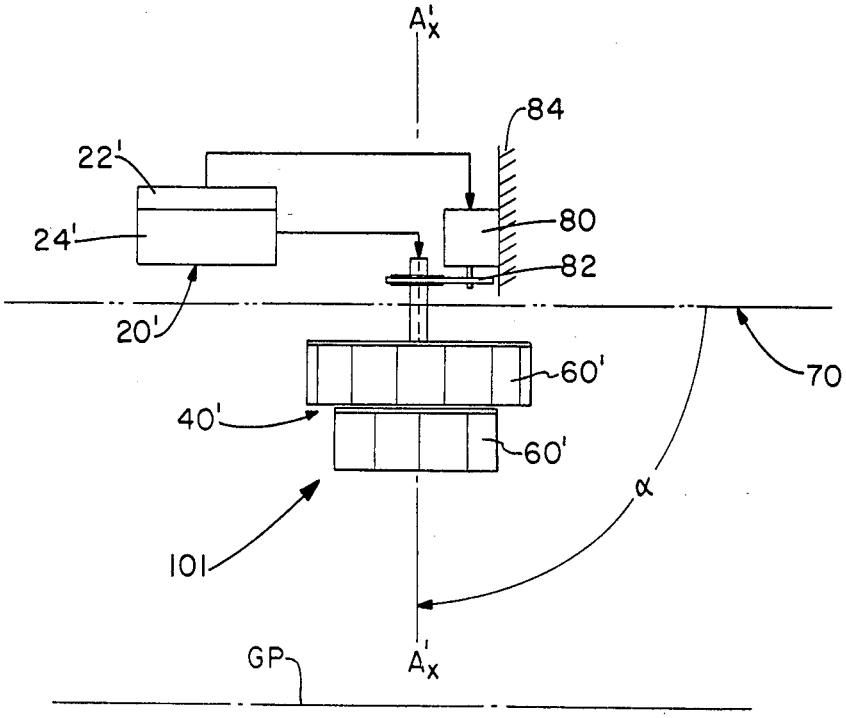

FIGS. 5*a*–5*e* are plan views illustrating various impact patterns of a sub-unit group which may be achieved with the spin-dispensing apparatus;

FIG. 6 diagramatically illustrates an impact pattern for a longitudinal deployment strategy;

FIG. 7 diagramatically illustrates an impact pattern for a lateral deployment strategy;

FIG. 8 illustrates by way of the shaded areas a selected impact pattern effected by a simultaneous ejection of a sub-unit group from a spin-dispensing apparatus traveling a ballistic trajectory;

FIG. 9 is a block diagram of the onboard control module which provides the required sequence signal to eject a particular sub-unit group in a manner to achieve a specific ground impact pattern of the group; and FIG. 10 diagramatically illustrates a second embodiment wherein the spin dispensing apparatus is mounted to a relatively stationary platform.

DETAILED DESCRIPTION OF THE INVENTION

Figure 1:
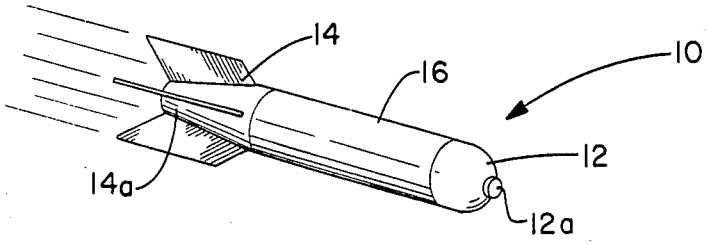
FIG. 1 is a perspective view illustrating a transport vehicle which may be applied to carry the spin dispensing apparatus of this invention.

Referring to the drawings, FIG. 1 illustrates a transport vehicle of a general type which may be adapted for carrying the spin-dispensing apparatus which comprises the present invention. The transport vehicle is generally indicated by reference numeral 10 and may include a forward nose piece 12, a rearward tail assembly 14, and a center section 16 which is the payload-carrying section of the vehicle. As hereinbefore mentioned, the transport vehicle 10 may be a self-propelled and guided vehicle and in this configuration the forward nose piece 12 may include appropriate guidance electronics 12*a* while the rearward tail assembly 14 may include appropriate propulsion means 14*a*. In an alternative configuration, the vehicle 10 may be carried aloft by an aircraft and launched in the manner of a bomb and thus directed towards the intended target. In any of the conceivable configurations of the transport vehicle 10, the vehicle may be adapted to house and carry the spin-dispensing apparatus which comprises the present invention and therefore the scope of the invention is not considered limited by the type and/or configuration of the transport vehicle 10.

Figure 2:
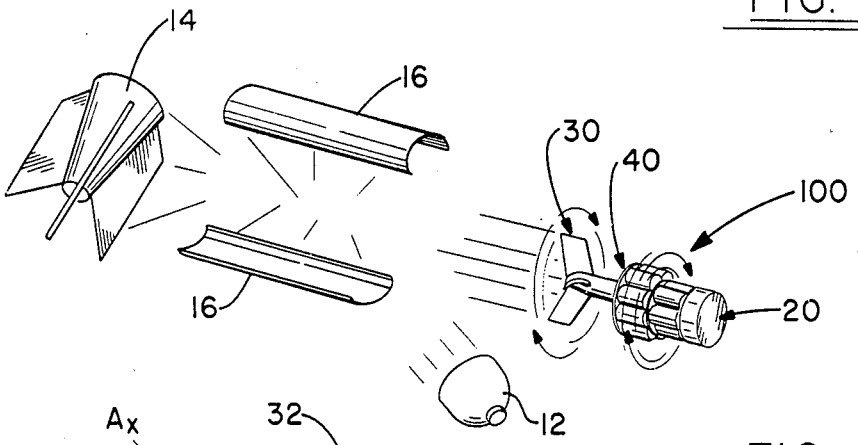
FIG. 2 is a perspective view illustrating a disengagement of the spin-dispensing apparatus from the transport vehicle as it approaches the target area.
Figure 3:
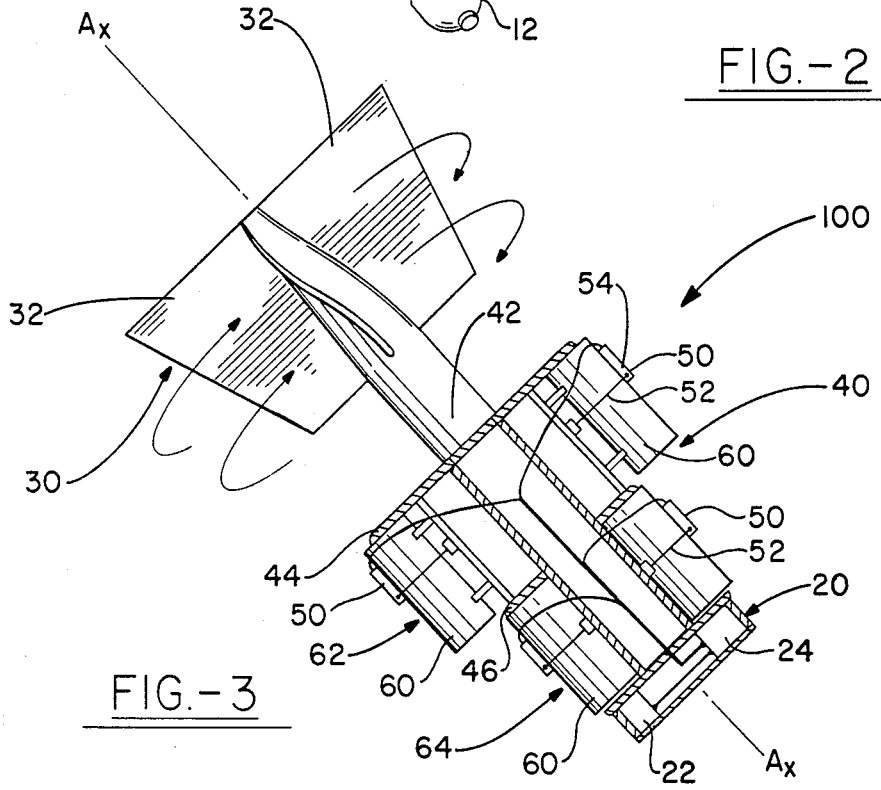
FIG. 3 is an elevational view, partially broken away and in section, of the spin dispensing apparatus which comprises the invention.

The spin-dispensing apparatus is more specifically shown in FIGS. 2 and 3 of the drawings and is indicated generally by reference numeral 100. FIG. 2 illustrates a disengagement of the spin-dispensing apparatus 100 from its transport vehicle 10, which vehicle separates itself in a well known and understood manner such that the spin-dispensing apparatus 100 continues on towards an intended target. Generally, a spin dispensing apparatus 100 comprises a control module 20, a spin generating means 30, and a payload section 40.

Referring now to FIG. 3 of the drawings, the payload section 40 is the most obvious part of the spin dispenser 100. The payload section 40 comprises a plurality of individual sub-units 60 which are arranged in a balanced pattern about a central core structure 42. The axis of the core 42 is indicated by line Ax—Ax and this is also the spin axis of the dispensing apparatus 100. While any number of sub-units 60 may comprise the payload section 40, this description and the drawing will be limited to a two-layered grouping indicated generally by reference numerals 62 and 64 respectively. The first group 62 comprises 12 sub-units 60 positioned on a circular tray-like base 44 which is rigidly affixed to the core structure 42. The second group 64 comprises six sub-units 60 and these are positioned on a circular tray-like base 46 which is also rigidly affixed to the core structure 42 in a spaced axial position from the first group 62. While the groups 62 and 64 are shown in FIG. 4 as being positioned at different radial distances from the core 42, this arrangement is not a requirement of the invention. For example, both groups 62,64 may comprise the same number of sub-units 60 and these may be positioned at the same radial distance from the core 42. Therefore, the invention is not considered limited by the number or arrangement of the sub-units 60 which may comprise the payload section 40.

Continuing with respect to FIG. 3, the sub-units 60 are each individually positioned and held in position by a release means 50 which may be any type of electronically controlled mechanism adapted for a fast response release time of a particular sub-unit 60 to which it is associated. A specific release means 50 which worked well in test firings of a prototype dispenser comprised a simple cable 52 which encircled each respective sub-unit 60 and which included a clamp and guillotine-type wire cutter 54. Upon electrical actuation of the wire cutter 54, a simultaneous ejection of the associated sub-unit 60 was effected. Other possible release means 50 will become apparent to those persons skilled in the art suffice to say that the release means 50 is an electrically actuated device and/or mechanism which effects a simultaneous ejection of an associated sub-unit from the spin dispenser 100.

The spin generating means 30 may comprise radially extending fins 32 which are of a configuration such that the airstream imparts a rotation to the spin dispenser 100 about the Ax—Ax axis. The fins 32 may be adapted for a radial extension from a folded or packaged position when the dispenser 100 is housed in its transport vehicle 10. This may be accomplished by various techniques including a mechanical or electrical operation or by an automatic ram-air extension when the spin dispenser 100 is released by the transport vehicle and generates its own airstream. In any event, the spin generating means 30 may be specifically configured such as to generate a particular spin rate to the dispenser 100.

Referring to FIG. 9 of the drawings, the control module 20 includes a power supply 22 which provides the required power to operate various electronic components controlling the spin dispenser operation. The module 20 also includes a microprocessor 24 having a store of sub-unit firing sequences which determine the geometry of the impact pattern of the ejected sub-units 60. The module 20 further includes various sensors (not shown) which provide dispenser flight data 26 to the microprocessor 24 such as, for example, a velocity sensor, a spin rate sensor, and a pitch sensor. In its simplest form, the spin-dispenser apparatus 100 will initially receive target data 28 into the microprocessor and this data determines which sub-unit firing sequence will be used for a particular target geometry. The selected target data 28 may be provided to the spin-dispenser microprocessor 24 prior to launch if the target geometry is known. If however, the target geometry is not known, such data may be provided via a data link to the spin dispenser 100 after it is launched towards the target, or alternatively, the control module 20 may include an onboard mounted target sensor (not shown) of a conventional type which provides the required target data to the microprocessor 24. In any event, the microprocessor 24 is programmable such as to select from the store of firing sequences, a particular firing sequence 34 such that the ejected sub-units 60 impact a target area in the pre-selected geometric pattern.

Various geometric impact patterns which may be had by way of the spin-dispensing apparatus 100 are illustrated in FIGS. 5*a*–5*e* and FIGS. 6, 7, and 8. FIGS. 5*a* and 6 illustrate the simplest geometric impact pattern, that being a longitudinal deployment strategy. Referring also to FIG. 4 of the drawings, assume for the purpose of this explanation that the figure is a tail end view of the payload section 40 and the spin dispenser 100 is traveling horizontally above the ground plane indicated at GP and is rotating clockwise in the direction of arrows 48. The dispenser velocity is $V_D$, its pitch angle is "zero" and its spin rate is within the range of 500–1000 rpm. In this example, sub-units 60 on opposite sides of the module 40 are simultaneously ejected such as to maintain stability of the apparatus 100 during flight and the first ejected pair is identified by "1A and 1B." As clearly evident in FIG. 4, sub-unit 1A will be ejected upwardly while sub-unit 1B will be ejected downwardly. In this circumstance, sub-unit 1A will travel farther and longer to reach ground impact while sub-unit 1B will travel a shorter distance and thus reach ground impact sooner. The points of impact for sub-units 1A and 1B are illustrated in FIG. 6 and these will be substantially along the same longitudinal line but in a spaced apart relation one to the other. In the same manner, sequentially ejected pairs 2A–2B, 3A–3B, etc. are ejected and their points of impact are also shown in FIG. 6.

Referring to FIG. 7, a lateral deployment strategy is illustrated and this impact pattern is accomplished by ejecting pairs of sub-units 60 at the instant when they are in the same vertical plane of the rotating dispenser 100. For example, instantaneous ejection of sub-units identified by 1AA and 1BB will result in their impacting the ground plane the same instant of time but laterally displace one from the other. In the same manner sequentially ejecting sub-units 2AA–2BB, 3AA–3BB, etc. will result in the impact pattern illustrated in FIGS. 5*b* and 7. Ejecting various of the sub-units 60 at other spin angles of the spin dispenser 100 will result in developing both longitudinal and lateral separation at ground impact. For example, a circular impact pattern of sub-units 60 may be had by an instantaneous ejection of the sub-unit group 62 when the pitch angle of the spin dispenser 100 with respect to the ground plane is 90 degrees. A pitch angle other than 90 degrees will result in elliptical impact patterns of various sizes as shown in the FIG. 5*d*. Thus, it must be appreciated that a temporal separation of the sub-units 60 at release from the spinning dispenser 100 may be combined with a spatial separation due to dispenser travel to obtain an almost unlimited variation in the impact pattern geometry.

As hereinbefore mentioned, the invention is not limited by either the number or arrangement of the sub-units 60 in their mounting within the payload section 40. To appreciate this fact, reference is made to FIG. 8 of the drawings wherein a computer simulation illustrates a controlled preselection of a plurality of subunits which were ejected simultaneously from a spinning dispenser traveling 400 ft./sec. at a pitch angle of 90 degrees with respect to the ground plane. The sub-unit groups are indicated by reference numerals 72 and 74 and are within the shaded areas. The legend which forms a part of the drawing illustrates ejection velocities $V_e$ associated with sub-unit groups indicated by the various symbols. The difference in the ejection velocities is accomplished by mounting the indicated sub-unit groups at different radial distances from the spin axis Ax—Ax of the spin dispenser apparatus 100. For example, the sub-units indicated by a diamond shape are mounted within the payload section 40 at a greater radial distance from the spin axis Ax—Ax than the sub-units indicated by the other symbol shapes. The sub-units indicated by the black dot are obviously closest to the spin axis, having the smallest ejection velocity $V_e$ and traveling the shortest distance before impact. From FIG. 8, it can be appreciated that five layered groups of sub-units are mounted in the payload section 40 and each group is positioned at a different radial distance from the spin axis to thus generate a different ejection velocity $V_e$. In accordance with FIG. 8, the sub-unit impact pattern indicated by the shaded areas is accomplished by a preselection of the microprocessor store of firing sequences and a simultaneous ejection of that sub-unit group. Alternatively, the total pattern which also includes the sub-units outside of the shaded areas will result from a simultaneous ejection of all of the sub-units stored within the payload section 40.

It may be further appreciated that the five groups of sub-units indicated in FIG. 8 by the various symbols may also be positioned at the same radial distance from the spin axis Ax—Ax of the apparatus while also creating the same impact patterns covered in the shaded areas 72,74. This may be accomplished by effecting a timed and sequential ejection of the sub-units at varying heights above the ground as the apparatus approaches the ground plane. For example, the preprogrammed ejection sequence will effect an initial ejection of the group indicated by the diamond symbol and at $\Delta t$ intervals later will effect ejection of the other remaining groups. Accordingly, and because all sub-units are at the same radial distance from the spin axis Ax—Ax, all sub-units will be released with the same ejection velocity $V_e$ but the diamond symbol group will travel a farther distance before impact while the circular dot symbol group will travel the shortest distance to impact. The result, of course, will be the same as illustrated in FIG. 8 by the shaded areas 72,74.

Finally, FIG. 10 of the drawings diagramatically illustrates an embodiment of the invention wherein a spin dispensing apparatus 101 is carried by and mounted to a relatively stationary but airborne platform. The platform is generally indicated by ghost lines 70 and may comprise any type of aircraft adapted for carrying the apparatus 101 to a designated target area. In this configuration the longitudinal axis Ax—Ax is substantially vertical with respect to the ground and the apparatus pitch angle indicated by "$\alpha$" in the drawing may vary from zero (horizontal) to ninety degrees (shown) with respect to the ground plane GP. According to this embodiment, the means to impart a spinning motion to the apparatus may comprise a variable speed motor 80 which includes any appropriate drive means 82 connected to the payload section 40' in any of the well-known techniques. The motor 80 and drive means 82 may be located within the confines of the platform 70 and may be affixed as at 84 to be relatively stationary with respect to the spinning payload 40'. Further, the apparatus control means 20' may also be located within the confines of the platform 70 and it includes a microprocessor 24' which functions in the same manner as hereinbefore described with respect to FIG. 9 and may also provide speed control to the motor 80. The control means 20' however may or may not include a power supply as indicated at 22' inasmuch as any power requirements may be drawn from power sources which are integral with the platform 70. For example, the power requirements for the microprocessor 24', the sub-unit release means (not shown), and the motor 80 may be provided by the power generating means and/or sources of the aircraft. Further, it is anticipated that the apparatus 101 may be movable along its longitudinal axis from a storage position within the confines of the platform 70 to an operative position outside of the platform as illustrated in the drawing.

From the foregoing, it will be recognized that various errors in the system may affect the ground impact pattern performance of the ejected sub-units 60. For example and as alluded to with reference to FIG. 5*d*, a change in pitch angle of the apparatus may not result in a circular impact pattern of simultaneously released sub-units but rather will result in an elliptical pattern as shown in that figure. Furthermore, and while the release of individual sub-units is considered to be tangent to an arc described at a radial position of the sub-unit with reference to the axis of rotation Ax—Ax, such release may be delayed by various inaccuracies in the system. It has been determined, however, that these errors may be corrected by introducing compensation into the microprocessor 24. This is considered to be within the skill and ability of persons having knowledge of the art to which this invention pertains.

While certain representative embodiments and details have been shown for the purpose of illustrating the invention, it will be apparent to those skilled in this art that various changes and modifications may be made therein without departing from the spirit or scope of the invention.

What is claimed is:

1. A method of dispensing a plurality of sub-units from an airborne apparatus such that the ground plane impact pattern of the plurality of sub-units substantially corresponds to a particular geometric ground target comprising the steps of:

mounting a payload of sub-units in the apparatus in a balanced arrangement about the apparatus longitudinal axis, each sub-unit having an associated electrically controlled means to effect release of the sub-unit from the apparatus;

providing an on-board microprocessor having a store of particular sub-unit ejection sequences indicative of various specific impact geometries;

spinning the apparatus about its longitudinal axis;

providing flight data and a selected target data to the microprocessor such that a particular sub-unit ejection sequence is selected which substantially corresponds to the particular ground target geometry; and releasing the sub-units according to the microprocessor selected sub-unit ejection sequence.

2. The method as set forth in claim 1 wherein mounting of the payload of sub-units in a balanced arrangement about the apparatus longitudinal axis is accomplished by positioning pairs of sub-units in both longitudinally and radially balanced arrangements.

3. The method as set forth in claim 1 wherein the selected target data is provided by preprogramming the microprocessor with such selected target data.

4. The method as set forth in claim 1 wherein providing selected target data is accomplished by collecting real-time target data as the apparatus approaches the target.

5. The method as set forth in claim 1 wherein providing selected target data is accomplished by obtaining such data from a source outside of the apparatus by means of a data link.

* * * * *